US006006393A

United States Patent [19]

Lynch et al.

[11] Patent Number: 6,006,393

[45] Date of Patent: Dec. 28, 1999

[54] COATING TOOL WITH VARIABLE FLEXIBLE CONNECTION BETWEEN HEAD AND HANDLE

[75] Inventors: Peter F. Lynch; Scott W. Osiecki; David A. Furth, all of Skaneateles; Ronald J. Kingston, Camillus; Robert F. Rosnak, Depew, all of N.Y.

[73] Assignee: Shur-Line, Inc., Lancaster, N.Y.

[21] Appl. No.: 09/088,320

[22] Filed: Jun. 1, 1998

[51] Int. Cl.[6] ..... A46B 5/02

[52] U.S. Cl. ..... 15/144.1; 15/244.2; 15/172; 16/110.1

[58] Field of Search ..... 15/209.1, 210.1, 15/244.1, 244.2, 231, 220.1, 144.1, 143.1, 172; 16/110.1, 900

[56] References Cited

U.S. PATENT DOCUMENTS 2,670,488 3/1954 Richards et al. .

4,974,286 12/1990 Stowell et al. .

5,339,840 8/1994 Koppel .

5,495,635 3/1996 Williams .

*Primary Examiner*—Terrence R. Till

*Assistant Examiner*—Jennifer C. McNeil

*Attorney, Agent, or Firm*—Phillips, Lytle, Hitchcock, Blaine & Huber LLP

[57] ABSTRACT

An improved coating tool (20) is provided with a variable flexible connection between a head and handle. The improved tool broadly includes a head (22), a handle (23), a flexible connection (21) between the head and handle to permit relative pivotal movement therebetween, and a restraining member (24) operatively arranged to adjustably limit the amount of relative movement between the head and handle, whereby the amount of permissible relative movement between the head and handle may be selectively varied. In the preferred form, the restraining member (24) may vary the flexibility of the connection.

19 Claims, 3 Drawing Sheets

COATING TOOL WITH VARIABLE FLEXIBLE CONNECTION BETWEEN HEAD AND HANDLE

TECHNICAL FIELD

The present invention relates generally to applicators for applying a coating (e.g., paint, varnish, stain, etc.) to a surface or preparing (e.g., sanding, roller painting, etc.) a surface, and, more particularly, to an improved coating applicator having a head portion, a handle portion, and a flexible connection therebetween, with means for selectively varying the extent of relative movement between the head and handle and/or the flexibility of the connection.

BACKGROUND OF THE INVENTION

Pad-type painting tools have enjoined substantial commercial success for use in certain applications. For example, an average homeowner can use a pad-type applicator to paint trim and border areas with fewer mistakes than with a brush or roller. Shortly after pad-type applicators were developed, hollow handles having internally-threaded portions were added to accommodate extension poles by which these types of applicators could be used to paint higher hard-to-reach places.

Many pad-type applicators have a head portion on which the pad is mounted, and a handle. A painter's arm is reasonably articulable within his personal range of motion. The painter normally moves his arm in whatever direction is required to keep the pad surface pressed against the surface to be painted. While this is viable for lower painting areas (i.e., those within the painter's reach), when painting higher areas through use of an extension pole, it is sometimes difficult to keep the pad in area connect with the wall.

To this end, others have provided paint applicators with flexible connections between the head and handle. For example, U.S. Pat. No. 3,369,268 discloses a pad-type applicator having a head and handle. The handle is pivotally mounted on the head, and is spring-biased to move toward one position. However, the extent of permissible movement between the head and handle is not adjustable, nor is the flexibility of the pivotal connection.

U.S. Pat. No. 4,594,816 discloses yet another pad-type applicator having a flexible connection between a head and handle. However, this reference does not appear to disclose means for limiting the extent of permissible relative movement between the head and handle, or means for varying the flexibility of the connection therebetween.

Accordingly, it would generally be desirable to provide an improved coating applicator having a flexible connection between the head and handle. The improved connection should limit the extent of relative movement between the head and handle and/or allow adjustment of the degree or extent of flexibility of the connection, in order that the improved tool may be better adapted to the personal characteristics of the painter, and the location of the surface to be coated.

DISCLOSURE OF THE INVENTION

With parenthetical reference to the corresponding parts, portions or surfaces of the disclosed embodiment, merely for purposes of illustration and not by way of limitation, the present invention broadly provides an improved coating tool (20) with a variable flexible connection (21) between the head (22) and handle (23).

The improved tool broadly includes a first part (22), such as a head; a second part (23), such as a handle; a flexible connection (21) between the parts to permit relative movement therebetween; and a restraining member (24) operatively arranged to adjustably limit the amount of relative movement between the two parts and/or the flexibility of the connection; whereby the amount of permissible relative movement between the parts may be selectively varied.

The handle (23) may be tubular and may be provided with an internally-threaded portion (41) which is adapted to receive the threaded marginal end portion of an extension pole. The handle may have at least one cushioned grip portion (39), which makes the handle "feel" more comfortable to the user. The cushioned grip may be formed of a suitable thermoplastic elastomer, such as a polyolefin.

In the preferred embodiment, the head, connection and handle are integrally formed of a suitable polypropylene. However, polyethylene or some other similar plastic could be readily substituted therefor. The connection has a web portion (31) that is more flexible to movement in one plane than it is to movement in another perpendicular plane. This web portion has major and minor transverse dimensions. In the preferred embodiment, the web portion may have a substantially rectangular transverse cross-section.

The restraining member (24) is mounted on one of the parts for selective movement toward and away from the other of the parts. This movement may be incremental between discrete positions. In the preferred embodiment, the member is mounted on the head for movement toward and away from the handle. The head is provided with a plurality of recesses (34), and the member has a detent (38) arranged to be received in any of these recesses. Thus, the member may be moved to any of a plurality of discrete positions at which the detent is received in one of the recesses. Moreover, in the preferred embodiment, a plurality of axially-spaced fins (32) extend normally (i.e., perpendicularly) outwardly from the web-like connection. The detent on the member is arranged to be positioned in the space between adjacent fins, to vary the flexibility of the connection.

Accordingly, the general object of the invention is to provide an improved coating tool.

Another object is to provide an improved coating tool with a variable flexible connection between the head and handle.

Another object is to provide an improved articulable coating tool having a head flexibly connected to a handle, with means for limiting the extent of relative movement between the head and handle.

Still another object is to provide an improved coating tool having means for selectively varying the extent or degree of flexibility between the head and handle.

These and other objects and advantages will become apparent from the foregoing and ongoing written specification, the drawings, and the appended claims.

DESCRIPTION OF THE PREFERRED EMBODIMENTS

Figure 1:
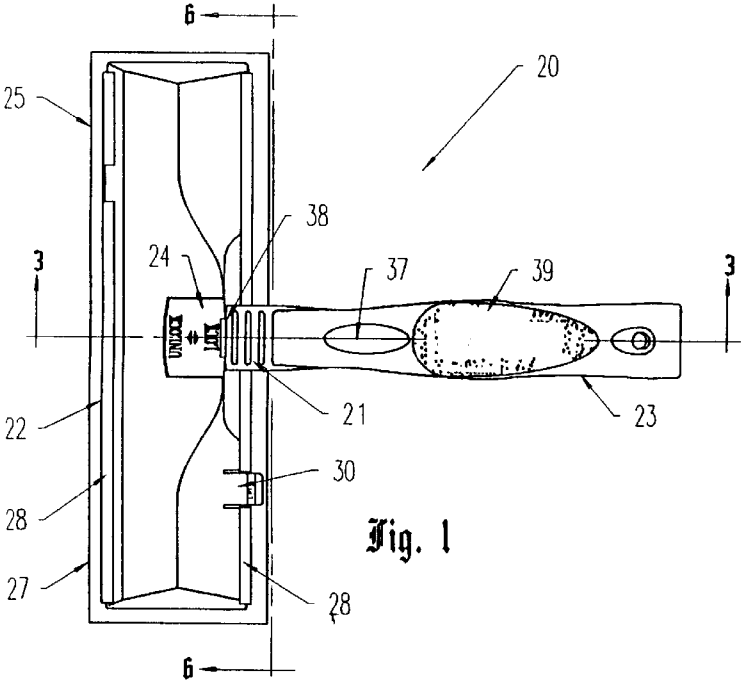
FIG. 1 is a top plan view of the improved tool, showing the restraining member as being in its unlocked position.

At the outset, it should be clearly understood that like reference numerals are intended to identify the same structural elements, portions, or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up", and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis or elongation, or axis of rotation, as appropriate.

Referring now to the drawings, and, more particularly, to FIGS. 1, 2 and 10–12 thereof, the present invention broadly provides an improved tool, generally indicated at 20, with a variable flexible connection, generally indicated at 21 between a head portion 22 and a handle portion 23. The improved tool is further shown as including a restraining member, generally indicated at 24, that is operatively arranged on one of the head and handle and is selectively engageable with the connection therebetween to limit the extent of relative movement between the head and handle and/or the flexibility of the connection.

Figure 2:
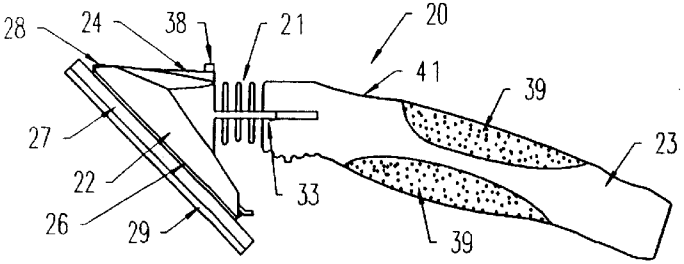
FIG. 2 is a left side elevation of the improved tool shown in FIG. 1.

As best shown in FIGS. 1 and 2, the improved tool is adapted for use with a pad-type applicator, generally indicated at 25. This applicator is shown as having a rigid base 26 provided with in-turned marginal ends 28, 28 that embrace and capture the marginal end portions of the head, an intermediate rectangular foam pad portion 27 and a flocked rectangular portion 29 providing the surface for applying the coating. In FIG. 1, the head is shown as having an integrally-formed flexible locking mechanism 30 that may be selectively snapped into a slot provided within one of base marginal ends 28. Thus, the pad 25 may be slidably inserted laterally onto the head portion with restraining mechanism 30 snapping into the slot on base 28.

In the preferred embodiment, the head 22, the handle 23 and the intermediate flexible connection 21 are all integrally formed of a suitable plastic material, such as polypropylene. The restraining member may be similarly formed of polypropylene, albeit of a separate part that is subsequently mounted on the connection. As best shown in FIGS. 1, 2, 6 and 7, the head portion is a thin-walled member having an articulated convex upper surface and a conversely-articulated concave lower surface.

Figure 4:
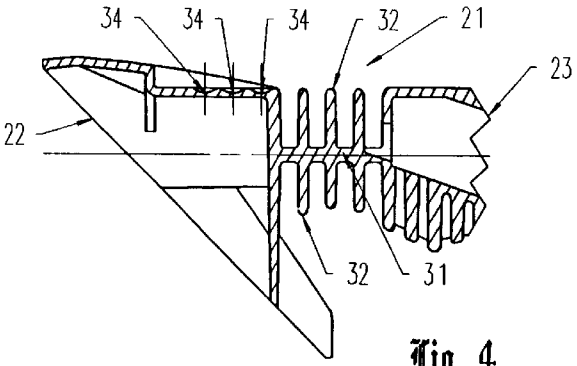
FIG. 4 is an enlarged fragmentary vertical sectional view of the head and flexible web, with the restraining member removed.
Figure 6:
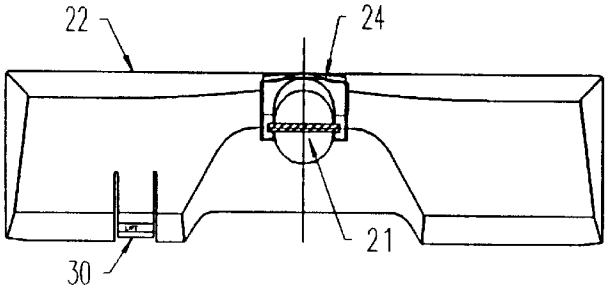
FIG. 6 is a fragmentary transverse vertical sectional view thereof, taken generally on line 6—6 of FIG. 1.
Figure 7:
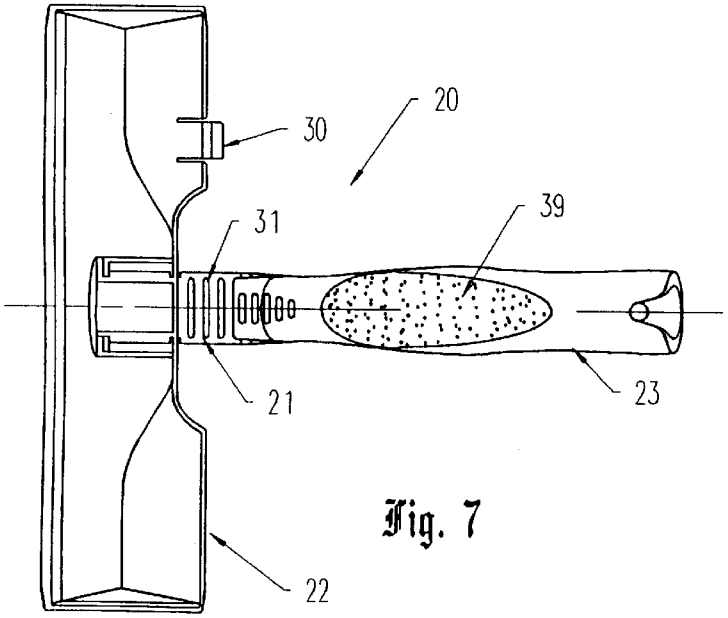
FIG. 7 is a bottom view of the improved tool shown in FIG. 1.

Referring now to FIG. 4, the connection is shown as including an integrally-formed flexible web 31. As shown in FIG. 6, this web has a substantially-rectangular transverse cross-section, with its major dimension being horizontal and its minor dimension being vertical. Thus, by virtue of the ribbon-like transverse shape of the web portion, the connection is more flexible to movement in a vertical plane then it is to flexure or movement in a lateral plane. A plurality of axially-spaced fins, severally indicated at 32, extend vertically upwardly and downwardly from web portion 31 for purpose hereinafter explained. As best shown in FIGS. 1, 2 and 6, the major horizontal dimension of the web portion extends laterally beyond the extent of the semi-circular fins so as to provide lateral marginal surfaces to guide movement of the restraining member. These lateral portions of the web may be provided with one or more barbs, indicated at 33 in FIG. 2, to prevent unintended separation of the restraining member from the web.

Figure 5:
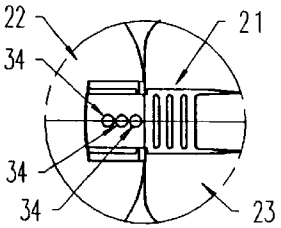
FIG. 5 is a fragmentary top plan view of the connection shown in FIG. 1, with the restraining member removed to illustrate the recesses into which the detent may be snapped.

Referring now to FIGS. 4 and 5, three axially-spaced upwardly-facing concave recesses, severally indicated at 34, extend into the head portion from an upper surface thereof.

Figure 9:
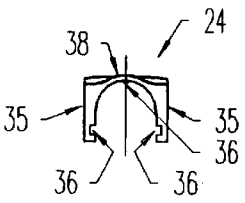
FIG. 9 is an end elevation of the improved restraining member.
Figure 8:
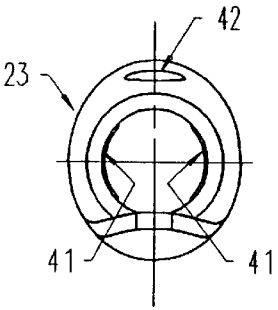
FIG. 8 is an axial end elevation of the handle of the improved tool.

Referring now to FIG. 9, the restraining member is shown as being a specially-configured generally saddle-shaped member provided with depending legs 35, 35. Each of these legs has a longitudinally-extending slot arranged to slidably engage the lateral marginal extensions of web 31. The restraining member 24 is further shown as having a detent 36 that is adapted to be selectively engaged with any of recesses 34 or the space between the marginal ends of the fins, as described infra. The restraining member is further shown as having a lug 38 for a user's thumb.

Figure 3:
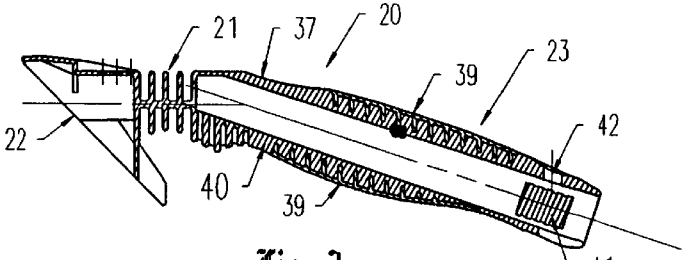
FIG. 3 is a fragmentary vertical sectional view thereof, taken generally on line 3—3 of FIG. 1, with the restraining member removed.

Referring now to FIGS. 1–3, the handle is shown as being a specially-configured hollow tubular member provided with a blind recess that extends in from its distal end toward the connection. The handle has at least two cushioned grip portions, severally indicated at 39, that are preferably formed of a suitable thermoplastic elastomer, such as a polyolefin. As best shown in FIG. 3, the handle has a polypropylene base portion 40 provided with a plurality of horizontally-spaced blind slots into which the thermoplastic elastomer material of cushioned grips 39 is molded and anchored. The handle also has a thumb depression 37. The handle further has internally-threaded segments, severally indicated at 41, to receive and accommodate the threaded marginal end portion of an extension pole (not shown). The handle also has a vertical through-hole 42 that communicates with the axially blind recess to provide a hole by which the tool may be hung when not in use.

Figure 10:
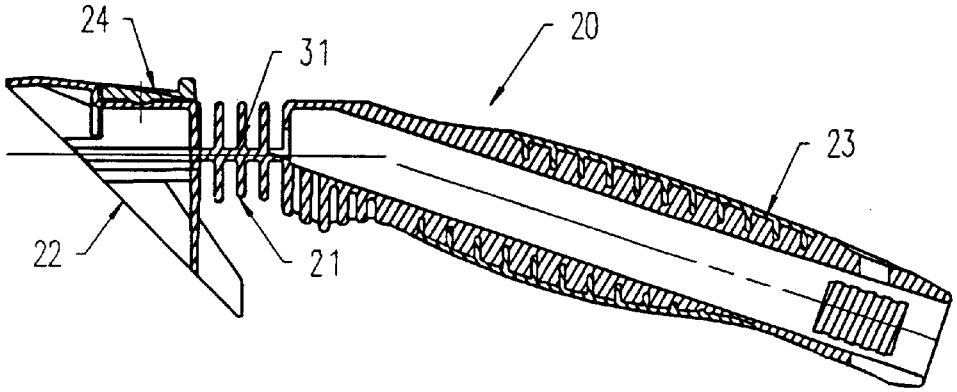
FIG. 10 is a fragmentary vertical sectional view thereof, this view showing the retaining means as being in its leftwardmost position so as to allow full flexing of the head relative to the handle.
Figure 11:
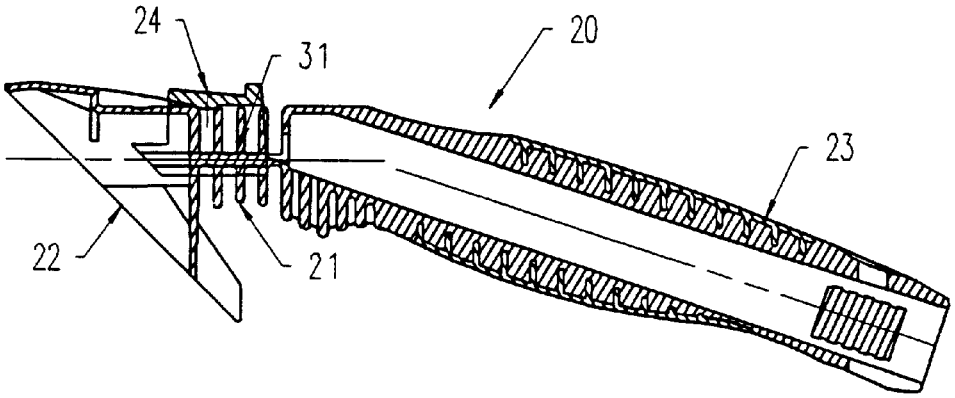
FIG. 11 is a view similar to FIG. 10, but showing the restraining member as having been shifted rightwardly to an intermediate position to allow partial flexing of the head relative to the handle.
Figure 12:
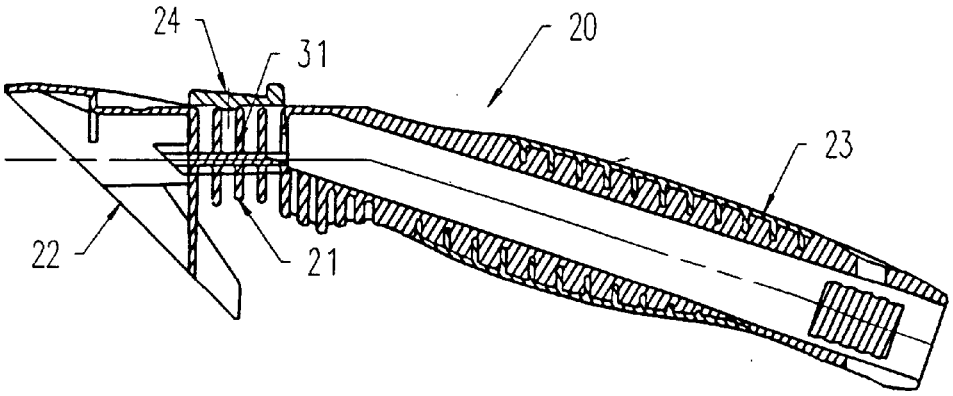
FIG. 12 is a view similar to FIGS. 10 and 11, but showing the restraining member as having been shifted further rightwardly to lock the head to the handle and to prevent relative flexing movement therebetween.

The operation of the improved tool is comparatively illustrated in FIGS. 10–12. These three figures are similar to FIG. 3, but show the restraining member as being in various positions to vary the extent of permissible relative movement between the head and handle and/or the flexibility of the connection. In these three figures, the pad has been removed merely for clarity of illustration.

In FIG. 10, the restraining member is shown as having been pushed forwardly to its fully unlocked portion. This represents an out-of-the-way position in which the restraining member does not adversely affect flexure of the head relative to the handle. In other words, the head may move pivotally relative to the handle through flexure of web portion 31.

FIG. 11 illustrates the restraining member as having been moved toward the handle to an intermediate position at which its detent engages the space between the head and the first fin. This represents an intermediate position of the restraining member which serves to restrain the extent of permissible movement of the handle relative to the head. Also, because the detent is engaged between the head and the first fin, this position does represent a change in the flexibility of the connection.

FIG. 12 shows the restraining member as having been switched further rightwardly relative to the head. In this form, the detent engages the space between the first two fins. This position of the restraining member represents the locked position of the improved tool, with the restraining member limiting the extensive permissible movement between the head and handle in one direction and stiffening the flexibility of the connection to movement in the opposite direction.

Therefore, the present invention provides an improved tool that is particularly useful with coating applicators and other wall- and surface-preparation devices, and that has a variable flexible connection between the head and handle.

Modifications

The present invention also contemplates that many various changes and modifications may be made. For example, while it is presently preferred to form the head, connection and handle integrally from polypropylene, these parts may be formed separately and subsequently assembled, or may be formed of other materials, as desired. Similarly, the restraining member may be formed of polypropylene or some other suitable material.

The tool is adapted for use with various types of coating applicators, such as pad-type applicators, brush-type applicators, and the like. However, the tool which is attached to the head is not deemed to be particularly critical, and may be readily varied. For example, the actual tool might comprise a pad about which sandpaper has been wrapped, with the flexibility of the connection allowing the large-area surface of the pad to remain in contact with the surface to be sanded. Other types of tools and implements may be mounted on the head as well.

The head itself may take the articulated shape shown, or may have some other shape or appearance. It may a thin-walled concave-convex member, as shown, or may have some solid shape, as desired. Similarly, the handle may be solid or hollow. Moreover, the handle may or may not have one or more cushioned grips and/or the thumb depression. Similarly, the presence of the internally-threaded portion and the hole 42 are optional.

In the preferred embodiment, the web is simply a ribbon-like member having a substantially-rectangular transverse cross-section. However, in other forms, the web could have other shapes as well. For example, the web could be circular, elliptical, an oval shape, or the like. Similarly, while the fins are shown as extending vertically upwardly and downwardly from the web portion, these fins need not be invariably provided. These fins provide a decorative appearance, and, from a functional point-of-view, interact with the restraining member to vary the flexibility of the connection. Similarly, while it is presently preferred that the restraining member have at least one detent to engage recesses on the head portion and/or the space between the fins, this may be varied as well.

Therefore, while the presently preferred form of the improved tool has been shown and described, and several modifications thereof discussed, persons skilled in this art will readily appreciate that various additional changes and modifications may be made without departing from the spirit of the invention, as defined and differentiated by the following claims.

What is claimed is:

1. A tool, comprising:

a first part;

a second par;

a flexible connection between said parts to permit relative pivotal movement therebetween; and a restraining mechanism operatively arranged to limit the amount of relative movement between said parts and to selectively vary the flexibility of said connection;

whereby the amount of permissible relative movement between said parts may be selectively varied.

2. A tool as set forth in claim 1 wherein said first part is a head.

3. A tool as set forth in claim 2 and further comprising a coating applicator mounted on said head.

4. A tool as set forth in claim 1 wherein said second part is a handle.

5. A tool as set forth in clam 4 wherein said handle is tubular and has an internally-threaded portion that is adapted to receive the threaded marginal end portion of an extension pole.

6. A tool as set forth in claim 4 wherein said handle has at least one cushioned grip portion.

7. A tool as set forth in claim 6 wherein said cushioned grip is formed of a thermoplastic elastomer.

8. A tool as set forth in claim 1 wherein at least one of said parts and connection is formed of polypropylene or polyethylene.

9. A tool as set forth in claim 1 wherein said parts and connection are formed integrally.

10. A tool as set forth in claim 1 wherein said connection is more flexible to movement in one plane than it is to movement in another plane.

11. A tool as set forth in claim 10 wherein said connection includes a web portion having a major transverse dimension and a minor transverse dimension.

12. A tool as set forth in claim 11 wherein said web portion has a substantially rectangular transverse cross-section.

13. A tool as set forth in claim 1 wherein said restraining member is mounted on one of said parts for selective movement toward and away from the other of said parts.

14. A tool as set forth in claim 13 wherein said member is adapted to be moved between discrete positions relative to said one part.

15. A tool as set forth in claim 14 and further comprising a plurality of recesses on said one part, and a detent on said member, and wherein said member is in a discrete position when said detent is received in one of said recesses.

16. A tool as set forth in claim 15 and further comprising a plurality of spaced fins extending outwardly from said connection.

17. A tool as set forth in claim 16 wherein said member is adapted to be selectively moved to a discrete position at which said detent is positioned between two of said fins.

18. A tool as set forth in claim 13 wherein said restraining member is mounted on said one part.

19. A tool as set forth in claim 1 wherein said parts are mounted for pivotal movement relative to one another.

* * * * *